United States Patent [19]

Wildeman

[11] Patent Number: 5,038,584

[45] Date of Patent: Aug. 13, 1991

[54] STITCH BONDED TEXTILE FABRIC WITH SIMUSOIDAL BUNDLE PATH

[76] Inventor: Martin Wildeman, 215 Longleaf Rd., Spartanburg, S.C. 29301

[21] Appl. No.: 639,924

[22] Filed: Jan. 10, 1991

Related U.S. Application Data

[63] Continuation of Ser. No. 353,088, May 17, 1989.

[51] Int. Cl.[5] ..... D04B 23/10; D04B 23/16

[52] U.S. Cl. ..... 66/85 A; 66/192

[58] Field of Search ..... 66/85 A, 190, 192, 195

[56] References Cited

U.S. PATENT DOCUMENTS

| | | | |
|---|---|---|---|
| 3,365,918 | 1/1968 | Hughes | 66/85 A |
| 3,597,941 | 8/1971 | Domazlice | 66/85 A |
| 3,967,472 | 7/1976 | Wildeman et al. | 66/85 A |
| 3,991,593 | 11/1976 | Bernert et al. | 66/85 A |
| 4,503,688 | 3/1985 | Vogel et al. | 66/85 A |
| 4,608,290 | 8/1986 | Schnegg | 428/101 |
| 4,631,933 | 12/1986 | Carey, Jr. | 66/85 A |
| 4,841,749 | 7/1989 | Petracek | 66/85 A |

FOREIGN PATENT DOCUMENTS

| | | | |
|---|---|---|---|
| 2525031 | 12/1976 | Fed. Rep. of Germany . | |
| 3140480 | 5/1983 | Fed. Rep. of Germany . | |
| 33771 | 7/1964 | German Democratic Rep. | 66/85 A |
| 2166460 | 5/1986 | United Kingdom . | |

OTHER PUBLICATIONS

Textile Manufacturer, vol. 98, No. 1162 Nov. 1962 pp. 18-22 Arutex-Stitch Bonding Combined with Weft Laying Syst.

*Primary Examiner*—Werner H. Schroeder
*Assistant Examiner*—John J. Calvert
*Attorney, Agent, or Firm*—Dority & Manning

[57] ABSTRACT

A stitch bonded fabric including a fiber fleece having a plurality of columns of warp-wise stitches, adjacent rows of the warp-wise stitches being offset so that bundles of fiber from the fleece captured thereby follow a sinusoidal path across the width of the fabric. A method of producing the stitch bonded fabric is also disclosed and claimed herein.

4 Claims, 7 Drawing Sheets

STITCH BONDED TEXTILE FABRIC WITH SIMUSOIDAL BUNDLE PATH

This is a continuation of application Ser. No. 353,088 filed May 17, 1989.

BACKGROUND OF THE INVENTION

Conventional stitch bonded textile fabrics are well known in the art. They are produced by bonding together the fibers of a fleece by means of a plurality of columns of stitches. If envisioned in terms of conventional woven textiles with warp threads and weft threads, the plurality of stitch columns constitute the warp yarns and the bundle of fibers encompassed within an individual stitch and adjacent stitches in the weft direction constitute the weft yarns.

The advantage of such a fabric is that it is composed almost entirely of weft-wise oriented staple fibers laid down in a fleece, which are much less expensive than spun or filament yarns or thread. The only yarns present are those in the columns of stitches. Stitch bonded fabric can also be produced more rapidly than by weaving or knitting.

There are several disadvantages of stitch bonded fabrics that limit its use and which virtually exclude it from use in apparel except, on occasion, as a liner material for suit coats and the like.

One such disadvantage is a low weft-wise strength or stability, which is attributable to a relatively poor binding power between the stitch loops and the weft-wise bundles of fibers that run through such loops. When the fabric is subjected to a weft-wise tension, the fiber bundles tend to slip through the loops, with a resultant distortion of the fabric.

Another disadvantage is a low resistance to pilling, again attributable to the poor binding power between stitch loops and fibers in the weft-wise bundles. Individual fibers pull out of the bundle and pill on the surface of the fabric.

A further disadvantage is that the fabric has poor draping characteristics. This is the result of the relatively large length of the stitches which, in turn, create relatively large diameter weft-wise bundles of fibers. These coarse bundles are relatively stiff, thereby resisting drape folds parallel to the warp-wise stitches.

SUMMARY OF THE INVENTION

The present invention provides a novel stitch bonded fabric and a machine and process for producing the same A conventional machine for producing stitch bonded fabric consists of a supply package of input fleece, feed belts that convey this fleece to an assembly including fleece pins or web holders, sinkers, a reciprocating needle bar with a plurality of needles aligned along said bar in a single plane, corresponding yarn guides on the other side of the web to lay the stitching yarn in the needle hooks, and a take-up means for the finished fabric. The just described elements are the main components of the stitch-bonding machine—numerous other ancillary components also exist in the machine.

In operation, the input fleece is selectively advanced past the needles as they repeatedly pierce the fleece. Each needle—and its corresponding yarn guide —creates a stitch column in the fleece in a warp-wise direction. Since all of the needles are in a single plane, each column of stitches has loops that are in weft-wise alignment with corresponding loops in adjacent columns. The aligned loops in a given weft-wise row capture a bundle of fibers such that the bundle is straight across the fabric in a weft-wise direction.

In the present invention the plurality of needles in the needle bar are not all in one plane, but instead are offset or staggered. Needles in the first, third, fifth, seventh, etc. position are in a first plane and needles in the second, fourth, sixth, eighth, etc. position are in a second plane. When the offset needles pierce the fleece and knit the warp-wise columns of stitches, the loops in adjacent columns are similarly offset from each other such that the weft-wise fiber bundles captured within the loops are distorted in an oscillated fashion—forming a pattern somewhat similar to two sinusoidal curves 180° out of phase with each other—rather than a straight bundle as is present in a conventional stitch-bonded fabric.

These twisted or distorted fiber bundles have a much improved binding power with the loops in the column of stitches, which greatly improves the weft-wise strength or stability of the fabric. The improved binding power is attributable to the wrap angles of the weft-wise fiber bundles relative to the individual stitch-loops in the warp-wise columns.

This improved binding power results in a fabric with a greater pilling resistance as well as a high weft stability. Additionally, the fabric drape is improved across the filling by the oscillating effect of the fiber bundles. The appearance of the fabric is also notable. The fiber bundles, due to the wrap angles, have a degree of alignment both toward the warp-like chains and the filling fiber creating a diagonal pattern having the appearance of a woven twill.

A further advantage of an offset needle configuration is that a finer guage fabric can be produced. With conventional single plane needle configurations the dimensional relationships between needles, fleece pins, sinkers and yarn guides limit the machines to 28 guage. When sufficient needle offset is achieved so that the guide bar blades can fit between the needles, two guide bars may be used to create a single bar construction with a fineness as high as 56 guage. A single sinker and a single fleece pin can serve two needles offset from each other by configuring the sinker and the fleece pin as a crank, in a manner to be more fully described below.

This finer guage fabric is characterized by superior strength, drape and appearance. It also enables the use of shorter fibers in the fleece.

The invention is more completely described below in relation to a preferred embodiment, and understanding is facilitated by reference to the drawings herein below.

DESCRIPTION OF THE PREFERRED EMBODIMENT

Figure 1:
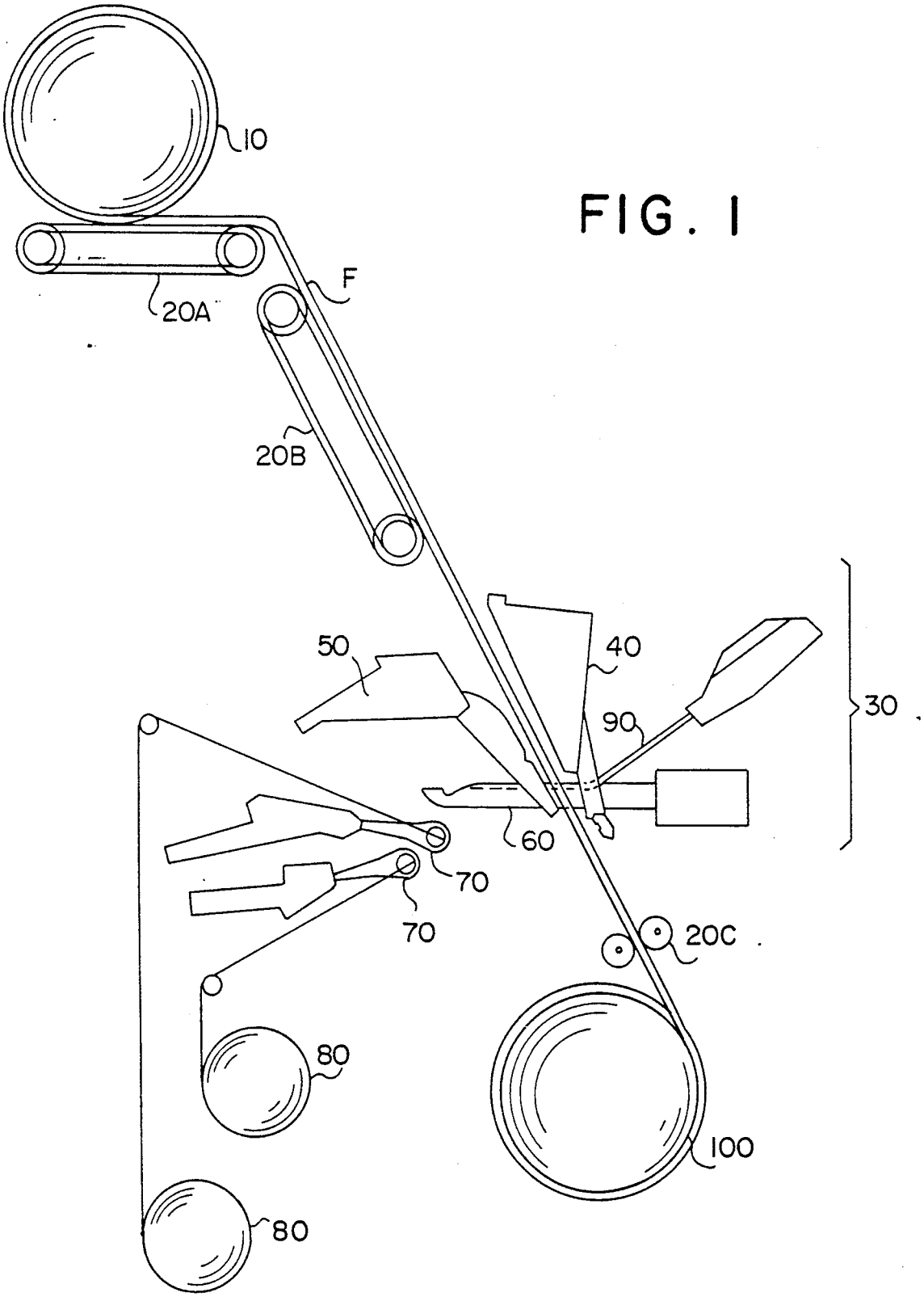
FIG. 1 is a schematic view of the major components of a stitch bonding machine.

FIG. 1 is a schematic of the major components of a stitch bonding textile machine. A roll 10 of fleece —such as produced by a cross folder—serves as an input supply of the fiber fleece which are to be bonded together to produce the fabric. Alternatively, the input fleece can be fed directly from a cross-folder. Feed belts 20A and 20B convey the fleece to the stitching zone 30, where it passes between fleece pins or web holder pins 50 and sinkers 40 in a conventional manner. Needles 60 stitch through the fleece, creating a plurality of warp-like columns of stitches from yarn supplied from packages 80 through yarn guides 70. Closing wire 90 functions in a conventional manner to close the hook on needle 60. Additional guide rolls 20C convey the stitch bonded fabric to take-up package 100.

Figure 2:
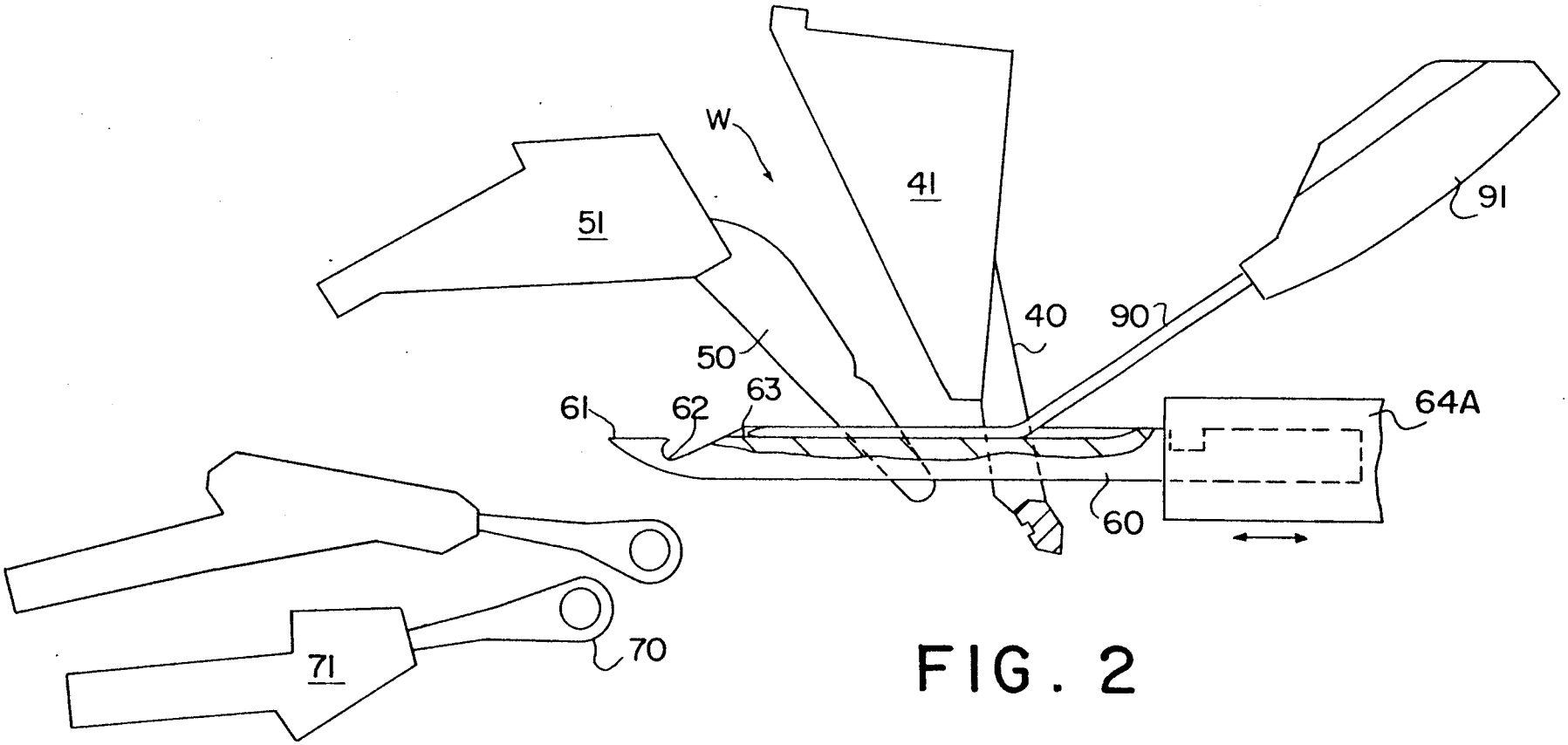
FIG. 2 is an enlarged schematic view of the stitching zone of a conventional stitch bonding machine.

The apparatus in the stitching zone is shown in greater detail in FIG. 2. Needle bar 64A holds a plurality of needles 60 (only the closest of which is visible in the figure), each of which has a point 61, a hook 62 and a groove 63 to accommodate closing wire 90. A web path W exists between knocking-over sinkers 40 and web holder pins 50, both of which are attached to the machine by means of sinker leads 41 and web holder pin leads 51, respectively. The point 61 of needle 60 passes through the web, picks up a stitching yarn in hook 62 from yarn guide 70, and pulls the yarn through the web to form, in cooperation with sinker 40, a stitch. In a conventional stitch bonding textile machine, there are a plurality of needles 60, all located in the same plane. In like manner, there are a corresponding plurality of sinkers and fleece pins.

Figure 3:
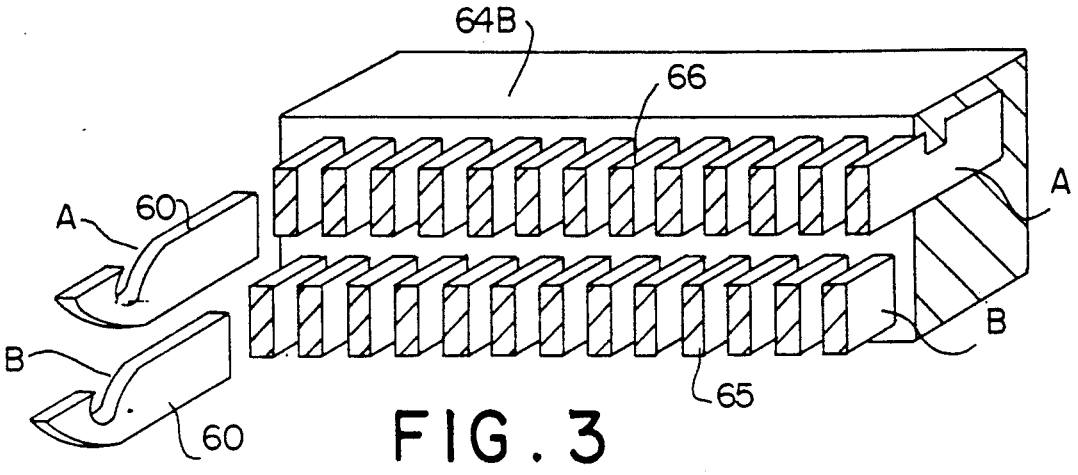
FIG. 3 is an oblique view of the needle bar of the present invention.
Figure 4:
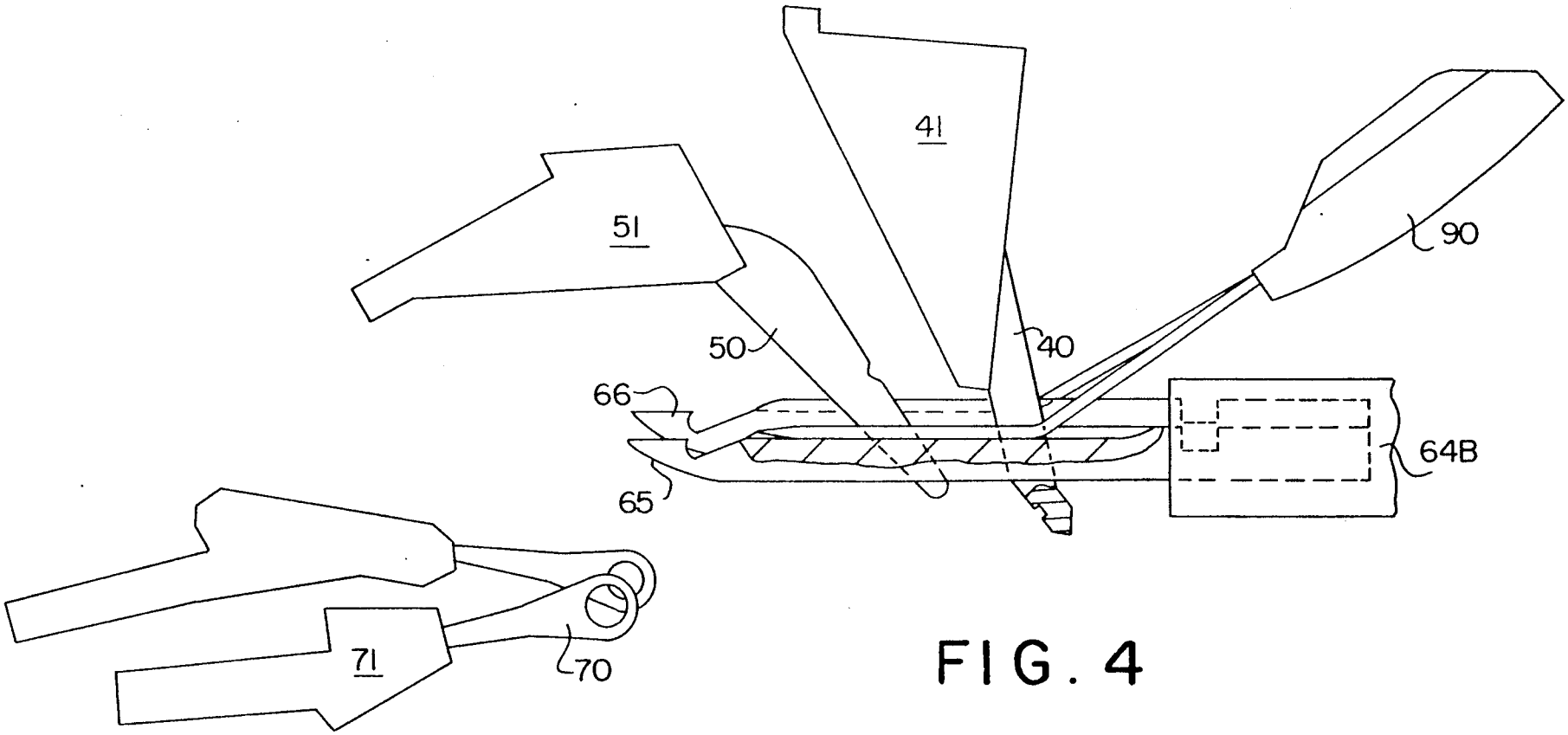
FIG. 4 is an enlarged schematic similar to FIG. 2 but with the needle bar of the present invention employed in the stitching zone.

One embodiment of needle bar 64B of the present invention is shown in an oblique view in FIG. 3. Needles 60 are staggered or offset from each other both vertically and horizontally such that they fall into two planes A—A and B—B and such that a needle in plane A lies over the space between two needles in plane B. The horizontal spacing between needles may be varied, as may be the vertical spacing. For example, the offset needles illustrated in FIG. 4 show less of a vertical spacing than the needles in FIG. 3. Thus, when viewed from the side, the embodiment of FIG. 4 has the front needle obscuring a portion of the needle behind it, and so on for all the needles in the bar. While this preferred embodiment is described with respect to offset needles in only two planes, it should be understood that offset needles in more than two planes are also contemplated for some applications.

FIG. 4 illustrates the stitching zone in a view similar to FIG. 2, but in which needle bar 64B of the present invention and its offset needles replace the conventional single plane needle bar 64A of FIG. 2. When viewed in conjunction with FIG. 3, needle 66 is in plane A—A and needle 65 is in plane B—B, although these planes are vertically closer to each other than those shown in FIG. 3. Again, a plurality of needles exists in each plane—only one in each plane is shown in FIG. 4.

Figure 5:
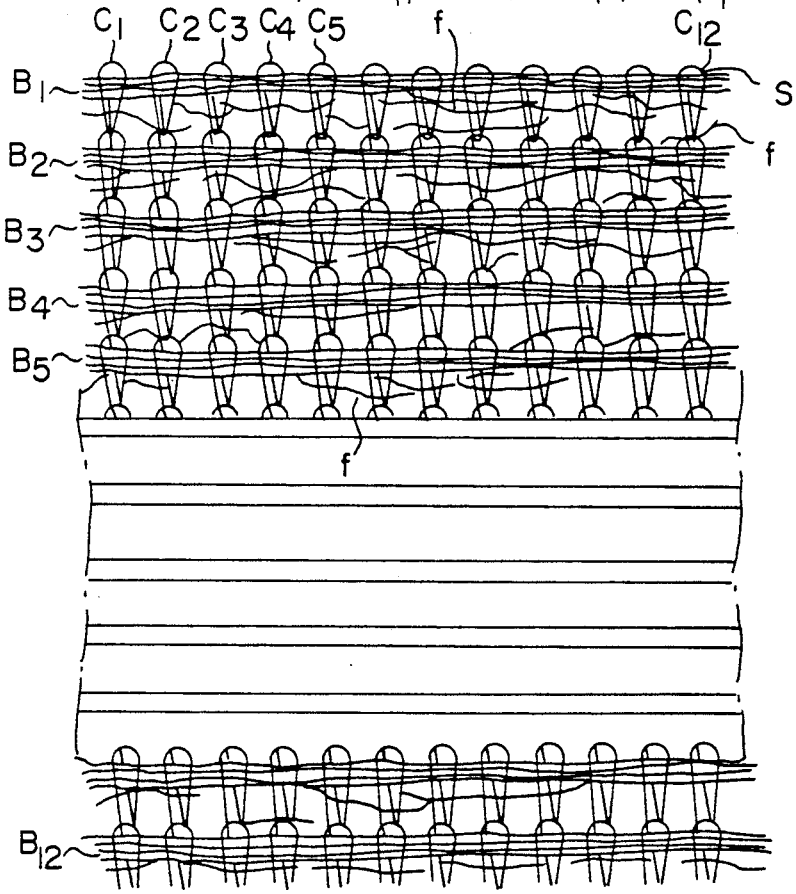
FIG. 5 is an enlarged view of the structure of a conventional stitch bonded fabric.

A conventional stitch bonded fabric is illustrated in FIG. 5. A plurality of stitch columns $C_1$, $C_2$, $C_3$, $C_4$, $C_5$ . . . $C_{12}$ are formed in the warp-wise direction, and a plurality of fiber bundles $B_1$, $B_2$, $B_3$, $B_4$, $B_5$ . . . $B_{12}$ are formed in the weft-wise direction.

As mentioned above, when envisioned in terms of conventional woven fabrics, the columns of stitches C constitute the warp yarns and the fiber bundles B constitute the weft yarns. The vast majority of the fibers in the fleece are captured by the individual stitches and form part of a given bundle but, as is apparent in FIG. 5, a small number of fibers f lie outside the bundles. When the fabric of FIG. 5 is subjected to a weft-wise tension, the fiber bundles have a poor binding power with their corresponding stitches, and slip through same with relative ease. This results in a fabric with a poor, or low, weft stability.

Figure 6:
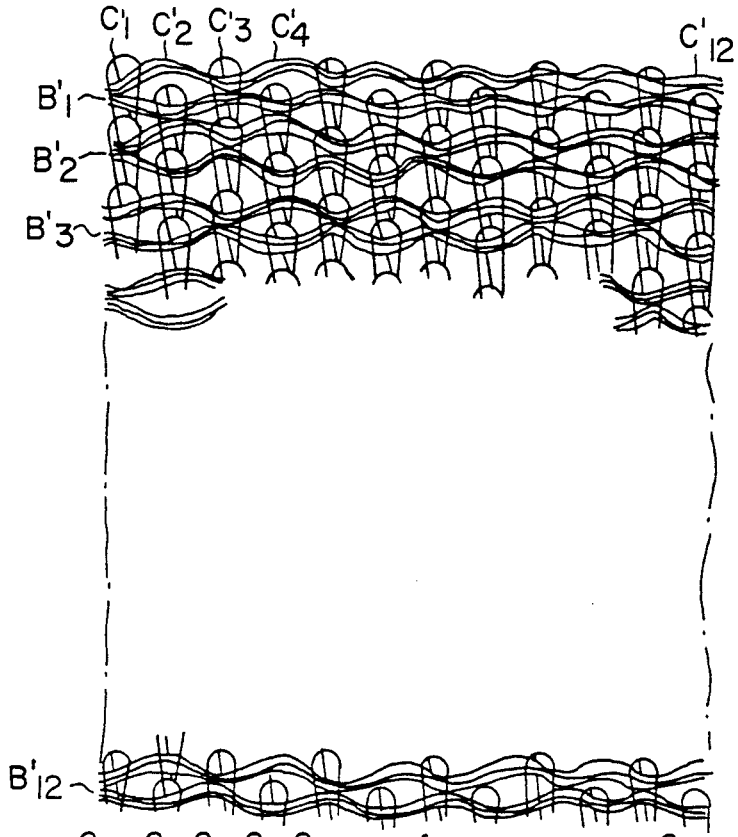
FIG. 6 is an enlarged view of the structure of a stitch bonded fabric according to the present invention.

A fabric produced according to the present invention is shown in FIG. 6. The columns of stitches are indicated by reference letters $C'_1$, $C'_2$, $C'_3$, $C'_4$ . . . $C'_{12}$, with columns $C'_1$, $C'_3$, $C'_5$ . . . knit by needles in one plane and columns $C'_2$, $C'_4$, $C'_6$ . . . knit by needles in a second plane.

Fiber bundles $B'_1$, $B'_2$, $B'_3$ . . . $B'_2$ form a oscillating pattern quite different from the pattern formed by the bundles in FIG. 5.

Figure 6A:
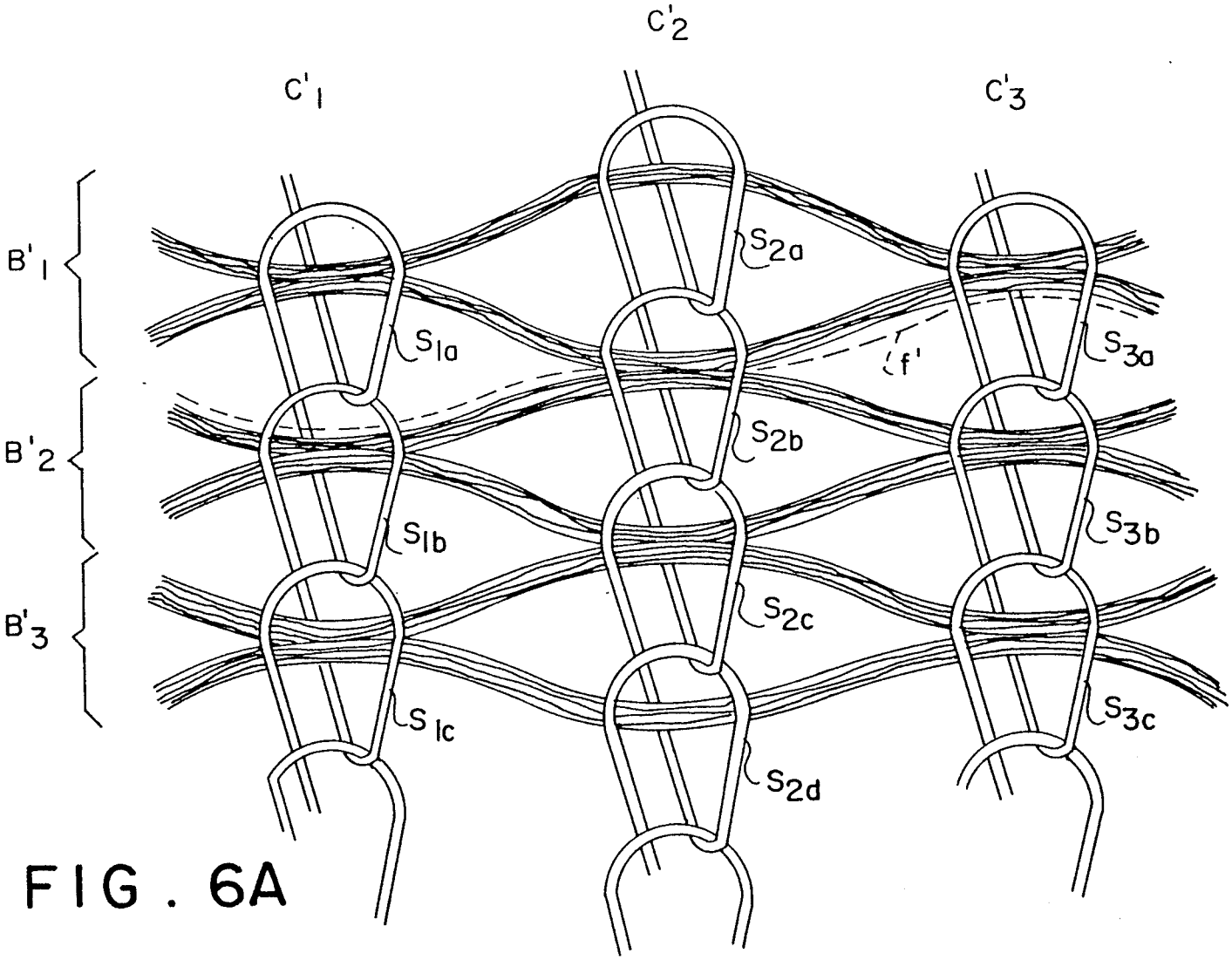
FIG. 6A is a still further enlarged view of portions of three stitch columns and three fiber bundles from the fabric of FIG. 6.

FIG. 6A is a greatly magnified view of the upper left corner of the fabric structure shown in FIG. 6. Three stitch columns $C'_1$, $C'_2$, $C'_3$ three fiber bundles $B'_1$, $B'_2$, $B'_3$ are shown in FIG. 6A. The oscillating path assumed by each bundle is readily apparent from FIG. 6A. Bundle $B'_1$ is completely encompassed in stitch $S_{1a}$ of column $C'_1$ but then, moving to the right of the figure (in a weft-wise direction), splits so that roughly half of bundle $B'_1$ is encompassed in stitch $S_{2a}$ of column $C'_2$ and the other half is encompassed in stitch $S_{2b}$ of column $C'_2$. Continuing to the right of the figure, bundle $B'_1$ comes together and is completely encompassed within stitch $S_{3a}$ in column $C'_3$. The bundle configuration just described occurs with the majority of the fibers in a given bundle. In actual application, there exists some minor but unpredictable fiber cross-over from bundle to bundle, such as shown by filament f' passing from bundle $B'_2$ to $B'_1$ and beyond.

This oscillating pattern repeats itself throughout the fabric and creates a more efficient binding power attributable to greater frictional engagement between bundle and stitch created by the wrap angle of the bundle around the stitch yarn. This creates a greatly improved weft-wise tensile strength and resistance to distortion, or a high weft stability. This fabric structure also results in good pilling resistance and improved drape characteristics across the filling.

Figure 7:
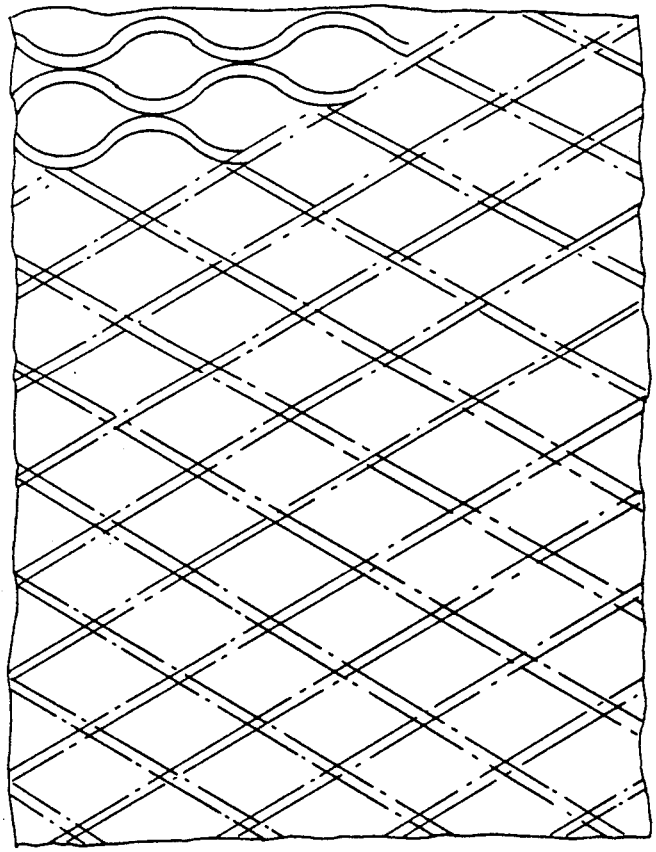
FIG. 7 is another enlarged view of a stitch bonded fabric according to the present invention, illustrating the twill-like surface appearance of the fabric.

With particular reference to FIG. 7, it can be seen that the just described oscillating pattern formed by the yarn bundles creates a diagonal, twill-like surface pattern on the fabric. The actual bundles are visible in the upper left corner of FIG. 7—the twill-like diagonal pattern is schematically illustrated in the remainder of FIG. 7.

Comparative tensile strength tests were run on a sample of conventional stitch bonded fabric and a sample of fabric produced according to the present invention. In the conventional fabric, the distance between stitches in a given column was 1.4 mm. In the sample according to the invention, the needle planes A—A and B—B were offset 0.7 mm and the distance between stitches in a given columns was held to 1.4 mm. Thus, the stitches in adjacent columns were offset from each other by half their length. The guage of the two samples was the same, i.e., 28 gauge. The fleece consisted of 4 denier—four inch length polyester. The weight of one sample of the conventional fabric was 4.67 ounces per square yard while the fabric of the invention weighed 4.40 ounces per square yard. Five test samples measuring four inches by six inches were taken from both the conventional fabric and the fabric made according to this invention. In the tables below, the test results are set forth. The test employed a conventional Scott Tensile Tester, with tension applied until the sample failed.

| | Tensile-Warp Direction lbs. | Tensile Weft Direction (Filling) lbs. | Initial Modulus Filling gm | Modulus Filling gm |
|---|---|---|---|---|
| | Conventional Fabric | | | |
| Sample 1 | 81 | 83 | 252 | 1083 |
| Sample 2 | 80 | 91 | 252 | 1083 |
| Sample 3 | 80 | 92 | 252 | 1083 |
| Sample 4 | 77 | 94 | 270 | 1305 |
| Sample 5 | 79 | 87 | 260 | 1083 |
| Average | 79 | 89 | 257 | 1127 |
| | Fabric According to Present Invention | | | |
| Sample I | 83 | 105 | 710 | 1630 |
| Sample 2 | 83 | 92 | 1054 | 1640 |
| Sample 3 | 73 | 127 | 1054 | 1833 |
| Sample 4 | 73 | 90 | 695 | 1830 |
| Sample 5 | 78 | 94 | 1054 | 1640 |
| Average | 78 | 102 | 913 | 1715 |
| % Difference | −1% | 15% | 255% | 52% |

The table headings are defined as follows:

Tensile-Warp Direction—lbs: A tensile force measured in pounds was applied in the warp direction until failure.

Tensile - Weft Direction (Filling)—lbs: A tensile force measured in pounds was applied in the weft direction until failure.

Initial Modulus Filling—gms.: An indication of force per unit stress, i.e., stress in grams divided by strain—i.e. % stretch. Thus, for example, Sample 1 of the conventional fabric indicates that for 252 grams of force applied, the sample stretched 1%. This is an indication of the resistance to distortion.

Modulus Filling—grams: i.e., the additional grams of force required to take the sample from its initial modulus to failure. This is an indication of the resistance to failure after the fabric has been distorted.

The samples were also subjected to a standard ASTM Random Tumble Pilling Test, and compared with samples in a visual grading scale of 1-5, with 5 being excellent. The conventional fabric was 3.0—i.e. moderate pilling. The fabric of the invention was 4.5—very slight pilling.

As is apparent from the above reported tests, there was an average 15% improvement in the weft-wise strength of the fabric, and the initial modulus indicates a dramatic 255% improvement in the fabric's ability to resist weft-wise distortion. Also, the ability of the inventive fabric to resist pilling was markedly improved over the conventional fabric.

I have also determined that offsetting the needles in a stitch-bonded textile machine permits the production of a finer guage stitch-bonded fabric. It is necessary carefully to control dimensions of the various components in the stitching zone.

Figure 8:
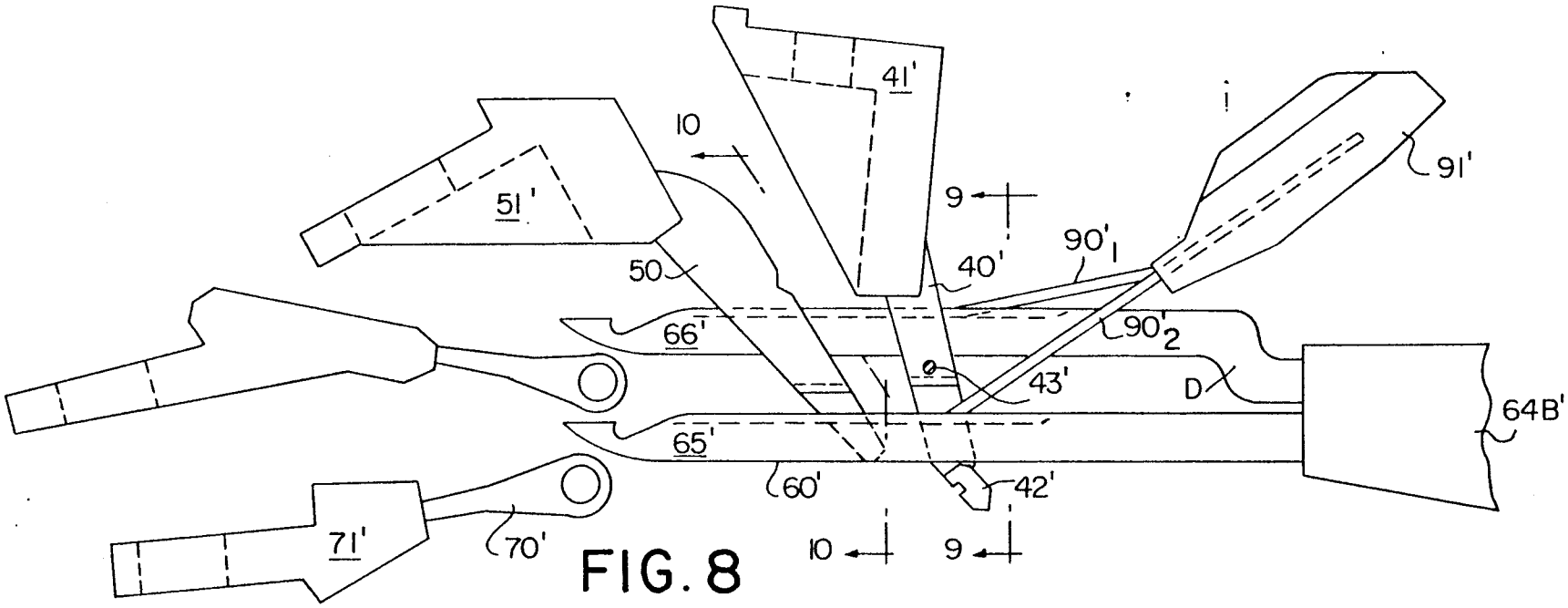
FIG. 8 is a view similar to FIG. 4 showing modifications to achieve a finer guage fabric.

FIG. 8 is a schematic view of the components in the stitching zone when modified to produce a fine guage fabric. Like elements are numbered as in FIG. 4, but with prime (') designations.

In this embodiment, the plane of needles which includes needle 66' is vertically offset from the plane of needles which includes needle 65' by an amount greater than that shown in either FIG. 4 or FIG. 3. The vertical offset may be, for example, four and one-half stitch lengths—i.e., 6.35-mm which is sufficient to accommodate yarn guide blades that are 2 mm wide. Several of the knitting components, or elements, require modification: (1) the sinker blades 40' must be made longer so that the offset needles can fit between sinker leads 41' and sinker nose 42'; (2) the fleece pins 50' must also be made correspondingly longer; (3) closing wires $90'_1$ and $90'_2$ must be offset in two planes corresponding to the needle offset such that they can ride in the corresponding grooves in the needles; and (4) the needles in the upper plane (as seen in FIG. 8) are cranked at location D so that needles in both planes can be cast into a conventional sized needle bar 64B'. Alternatively, if needle bar 64B is made larger in the vertical dimension, the upper needles need not be cranked.

The clearance between the yarn guide blade and needle—both in front and behind the hook—should preferably be a minimum of 1 mm.

With longer sinker blades, the opening of the sinker window X (see FIG. 9) will be large enough to accommodate both needles—in this example, the window would be 8.85 mm.

Figure 9:
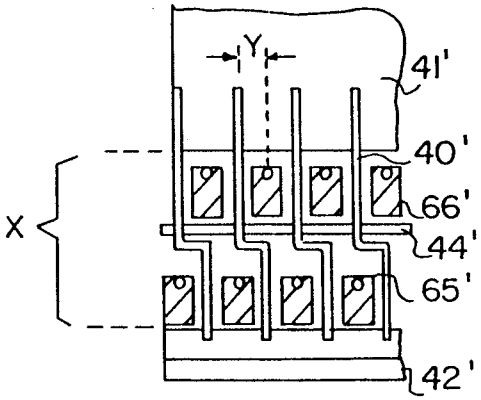
FIG. 9 is a cross sectional view of the cooperation between offset needles and crank-shaped sinkers.
Figure 10:
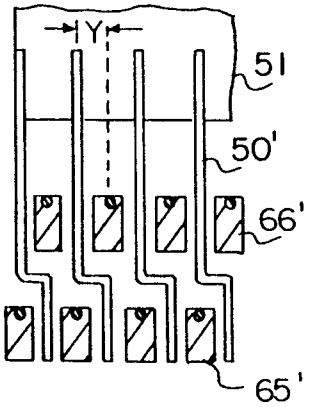
FIG. 10 is a cross sectional view of the cooperation between offset needles and crank-shaped fleece pins.

Both the sinker blades and the fleece pins are bent into a crank-like configuration, as is visible in FIGS. 9 & 10. This cranked configuration permits a single sinker blade, and a single fleece pin, to serve two needles, one in each plane.

Sinker pins 40' should preferably have a hold 43' punched in each with a supporting wire 44' running therethrough to support the back side of the needles 66'. (The lower needles 65' are supported by sinker nose 42'.)

The crank offset of both sinker blades and fleece pins is determined by dividing the guage—i.e., the number of needles per inch into 25.4 mm—the number of millimeters in one inch. Thus for a 56 guage needle assembly, the crank offset is 0.454 mm, indicated by Y in FIGS. 9 and 10.

A comparison of the relative cost of manufacturing a conventional 4 oz., 28 guage, 70 den. yarn fabric with an equivalent 4 oz., 56 guage, 50 den. yarn fabric indicates that the 56 guage fabric is only about 3 cents/sq. yd. more expensive than the 28 guage fabric, with no loss of efficiency in knitting.

The finer guage fabric would have vastly superior strength, drape and appearance, and would enable the use of a shorter staple length fiber in the fleece.

I claim:

1. A method of producing an improved stitch bonded fabric comprising the steps of:

a) feeding a fibrous fleece to a stitching zone, said stitching zone having a plurality of compound needles and a plurality of knocking over sinkers on one side thereof;

b) piercing said fleece with said needles, each adjacent needle being spaced apart from each other adjacent needle in two directions;

c) supplying stitching yarns to said needles after said needles have pierced said fleece;

d) withdrawing said needles and stitching yarns through said fleece to form stitching loops, said loops engaging and holding bundles of fibers from said fleece therewithin with said fiber bundles follow a generally sinusoidal path across said fleece in a direction transverse to movement of said fleece, resulting in enhanced fabric stability in such direction.

2. The method as defined in claim 1 wherein said adjacent needles are offset by approximately one-half stitch length in the direction of movement of said fleece.

3. A method of producing an improved stitch bonded fabric on a machine having a stitching zone having a plurality of needles located on one side of said stitching zone and being reciprocable with respect thereto, and a plurality of knock-over sinkers cooperating with said needles, said each of said needles being offset from other adjacent needles in at least two directions, and with a stitching yarn supply for each needle located on an opposite side of said zone, comprising the steps of:

a) continuously feeding a fleece to said stitching zone;

b) piercing said fleece with said needles at said offset locations with a forward end of said needles extending beyond said fleece, each of said needles forcing portions of said fleece therearound away therefrom in opposite directions with respect to fleece movement;

c) supplying stitching yearns to each of said needles at said extending end;

d) withdrawing said needles and said stitching yarns through said fleece with said stitching yearns engaging forced away portions of said fleece, and forming loops of said stitching yarns to hold a fleece portion engaged thereby, said loops interengaging with previously formed loops;

e) repeating the steps b) through d) to produce a chain of said loops in the direction of fleece movement; and f) thereby causing said held fleece portions in said loops to follow a sinusoidal path across the width of said fleece.

4. A stitch bonded fabric comprising a fiber fleece of columns of warp-wise stitches, said stitches adjacent to each other in a weft-wise direction being offset such that the bundles of fibers captured within said stitches are distorted in an oscillated fashion forming a pattern similar to two sinu-soidal curves 180° out of phase with each other.

* * * * *